United States Patent [19]

Zlotek

[11] 4,080,101

[45] Mar. 21, 1978

[54] BLADED ROTOR FOR FANS

[75] Inventor: Rudolf Zlotek, Mutters near Innsbruck, Austria

[73] Assignee: Willi Seeber, Kardaun (Bozen), Italy

[21] Appl. No.: 533,504

[22] Filed: Dec. 17, 1974

[30] Foreign Application Priority Data

Dec. 17, 1973 Germany ..... 2362758

[51] Int. Cl.[2] ..... F01D 5/32

[52] U.S. Cl. ..... 416/216; 416/218

[58] Field of Search ..... 416/229, 230, 241 A, 416/212, 212 A, 218, 215–217

[56] References Cited

U.S. PATENT DOCUMENTS

| | | | |
|---|---|---|---|
| 943,348 | 12/1909 | Hodgkinson | 416/218 |
| 977,300 | 11/1910 | Haines | 416/218 |
| 1,035,543 | 8/1912 | Dake | 416/217 |
| 1,423,466 | 7/1922 | Snyder | 416/212 A X |
| 2,410,588 | 11/1946 | Phelan et al. | 416/212 A X |
| 2,805,838 | 9/1957 | Pickup | 416/212 X |
| 3,003,745 | 10/1961 | Ferguson et al. | 416/212 A X |
| 3,515,501 | 6/1970 | Palfreyman et al. | 416/230 X |
| 3,532,439 | 10/1970 | Palfreyman et al. | 416/213 |
| 3,545,882 | 12/1970 | Williamson | 416/190 |
| 3,616,508 | 11/1971 | Wallett | 416/212 A X |
| 3,675,294 | 7/1972 | Palfreyman et al. | 29/156.8 R |
| 3,728,041 | 4/1973 | Bertelson | 415/217 X |
| 3,801,221 | 4/1974 | Zlotek | 416/214 |
| 3,850,546 | 11/1974 | Mason | 416/212 A |

FOREIGN PATENT DOCUMENTS

| | | | |
|---|---|---|---|
| 131,574 | 2/1947 | Australia | 416/215 |

*Primary Examiner*—Everette A. Powell, Jr.
*Attorney, Agent, or Firm*—Stevens, Davis, Miller & Mosher

[57] ABSTRACT

A fan rotor has a hub having a peripheral rim, a plurality of segments assembled together in the rim to form a ring, at least some of the segments having a base portion which forms a segment of the ring and a blade integral with the base and extending outwardly therefrom, slots in the segments and a U-shaped clamping member having its legs in slots of adjacent segments which hold the segments together.

3 Claims, 4 Drawing Figures

BLADED ROTOR FOR FANS

This invention relates generally to a bladed rotor for fans and, in particular, to fans for the cooling system for an internal combustion engine in which the blades are formed as individual components and the base members which are integral with the blades and are in the form of segments of a ring joined together to form a closed ring which is held by the peripheral rim of a hub.

Such rotors are disclosed in DT-OS 2,046,486 and U.S. Pat. No. 3,801,221 issued Apr. 2, 1974, the disclosures of which are incorporated herein by reference. Here the shape of the base members which form the segments of the ring is such that the individual blades or components can be pre-assembled together to form a rigid ring of blades. The hub is then fitted onto this ring.

This allows practical manufacture of the rotor. In particular, it is no longer necessary to provide a separate mold for the casting or injection-molding of different rotors. Different rotors with different numbers of blades can be produced using one with the same individual component comprising a blade with a base member or ring segment on it.

However, there are limits with regard to the holding together of the closed ring of blades before the fitting of the hub. The curvature of the foot or base member in the peripheral direction is such that only with one specific number of base members, and therefore of blades, is an exact circular closed ring formed. It is possible to assemble more base members into a closed ring which then, it is true, is no longer exactly of circular form, but it does hold together. However, increasing the number of base members above a certain limit endangers, the holding together.

It is an object of this invention to overcome this drawback. It is another object of this invention to provide a means for fastening together the segments of a bladed rotor fan having fan blades integral with base members which are adapted to be assembled together in a ring structure with spacer elements as segments to form rotors or various diameters and to be attached to various diameter hubs.

The invention provides a means for making bladed rotors of widely differing numbers of blades and/or hub diameter from identical blades with foot portions or base members formed integrally on them and, if necessary, with, spacer members which are put together to form a closed self-sustaining ring before the fitting of the hub. Clamp members are employed for joining the base members and spacers together as segments of a ring to increase the strength of the finished rotor. If, moreover, closure plugs are used, then trapping of air in the rotor an injection of plastic around the ring is avoided, the segmental components of the ring preferably likewise being of plastic.

Two different embodiments of bladed fan rotors provided by the invention are described in the following by way of example with reference to the drawings, in which.

Figure 1:
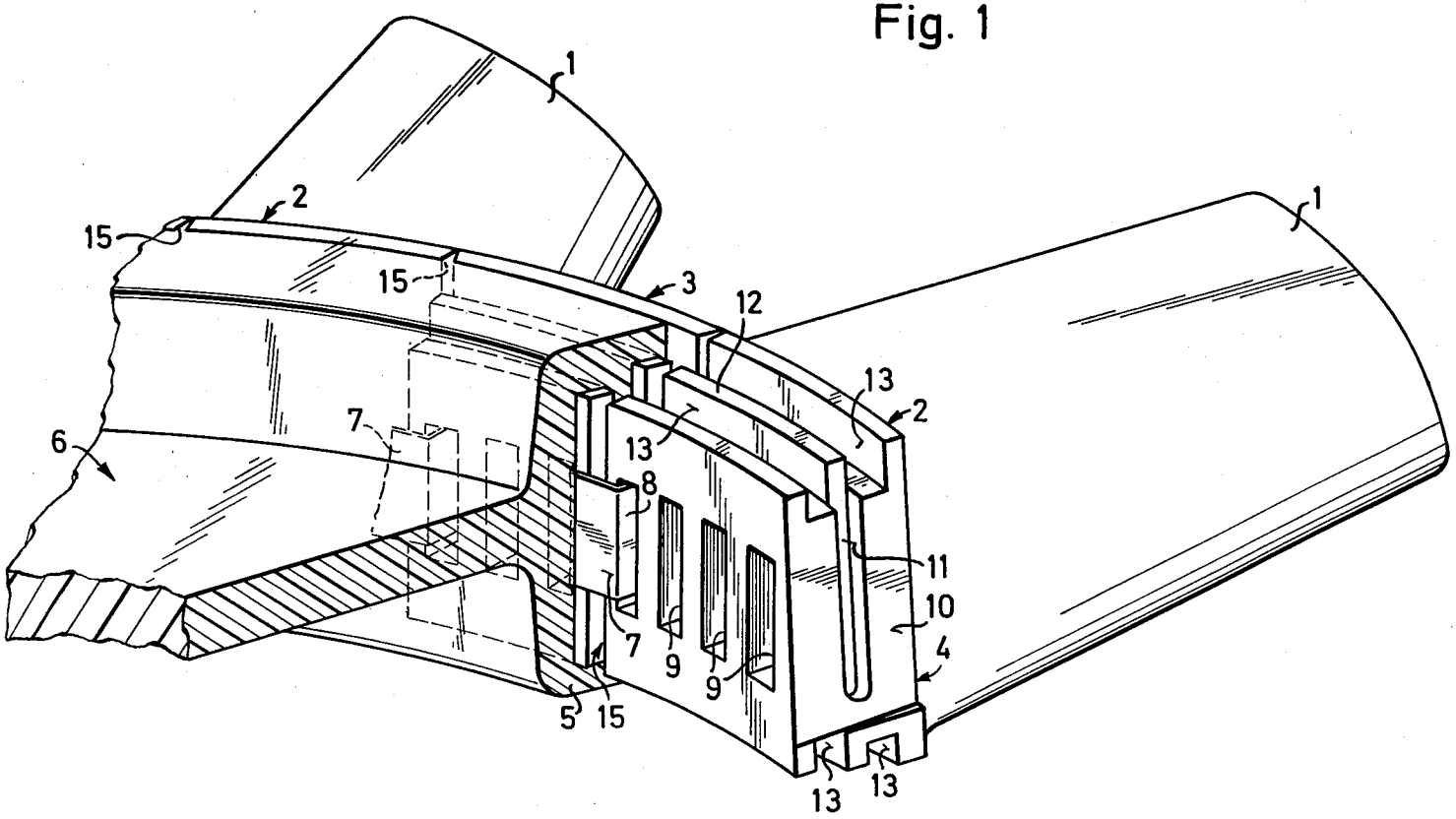
FIG. 1 is a perspective view, partially in section, of part of one embodiment of the rotor provided by the invention.
Figure 2:
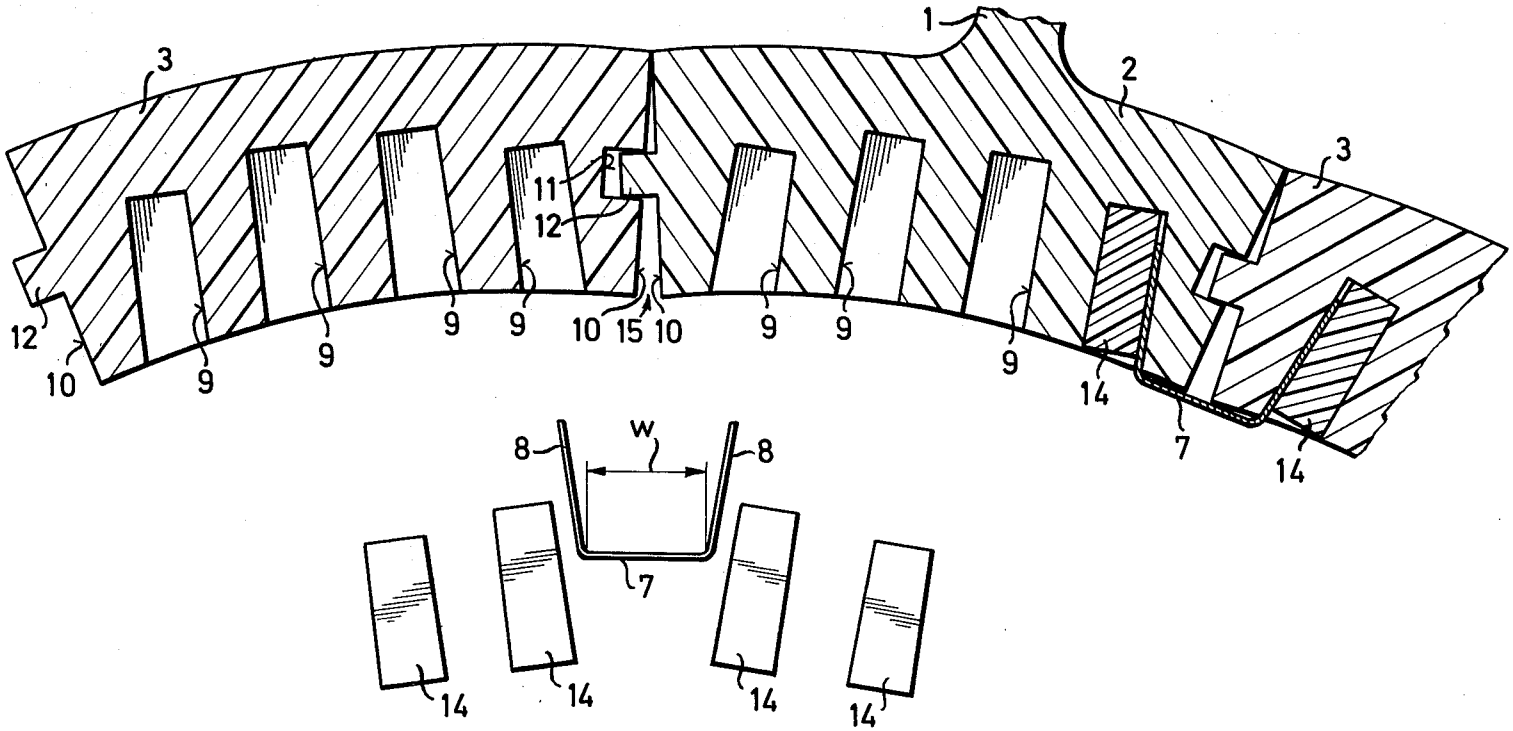
FIG. 2 is a section through the base portion of the blade and the adjacent spacer of the rotor of FIG. 1 before and after the insertion of the connecting clamps and of closure plugs.
Figure 3:
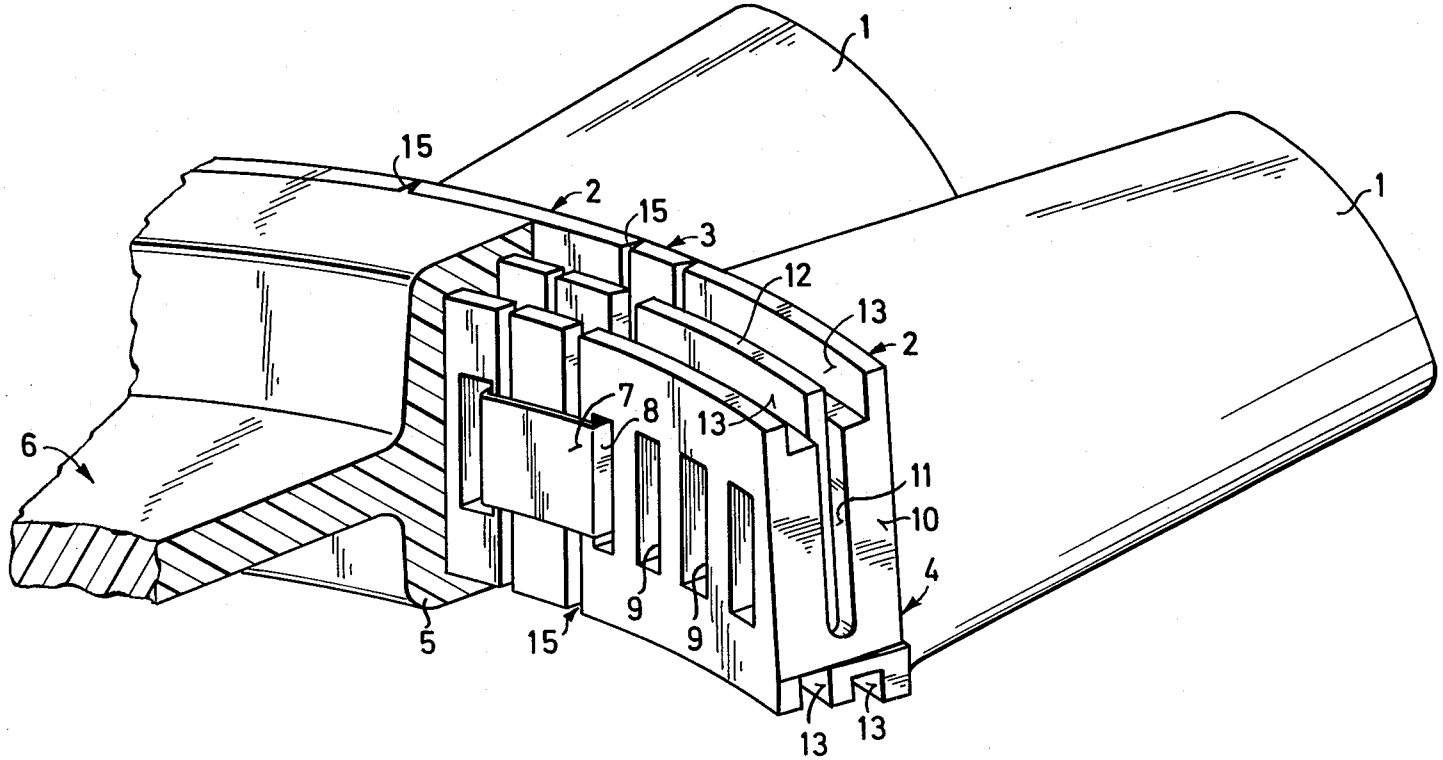
Figure 4:
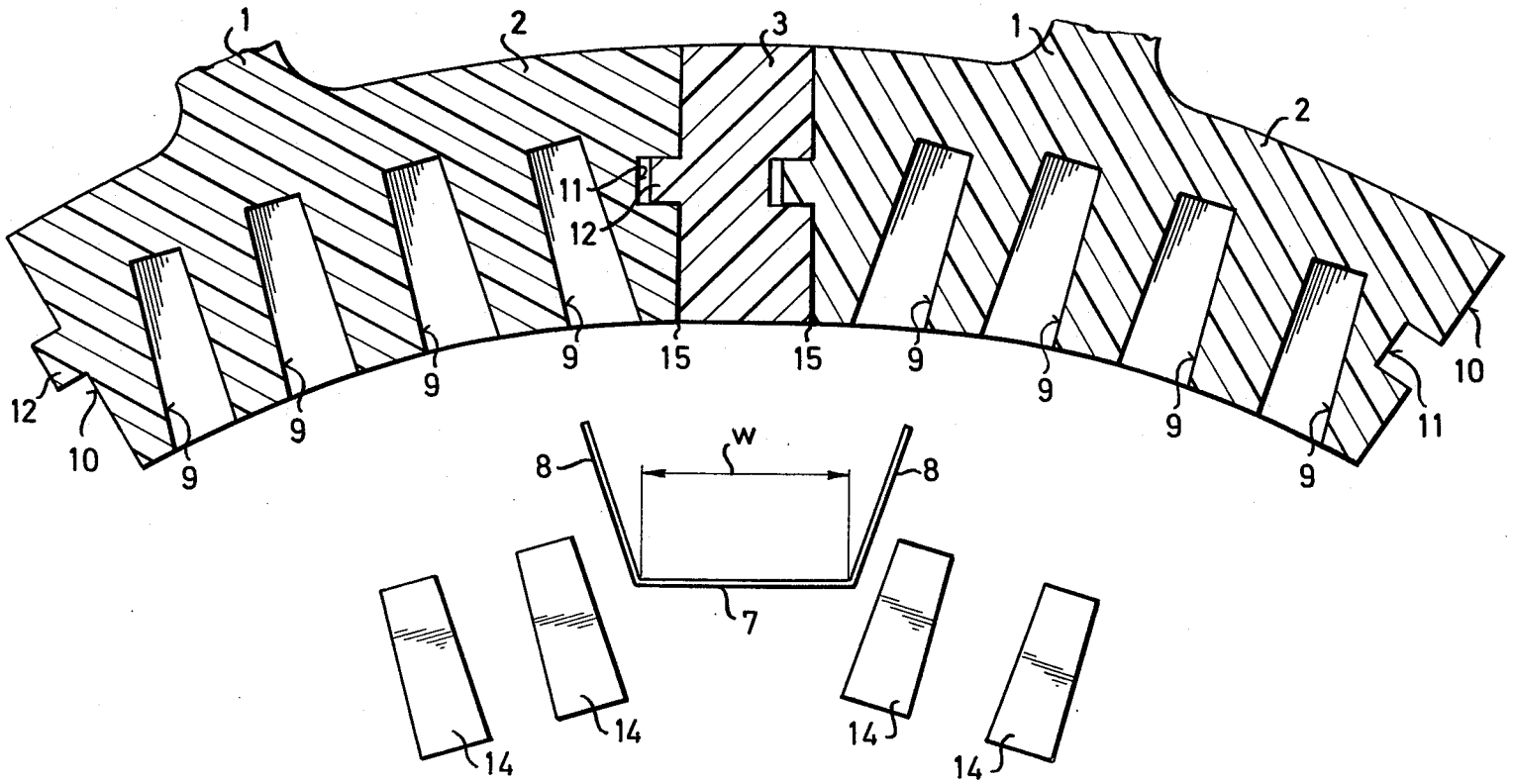

FIGS. 3 and 4 are, respectively, views corresponding to FIGS. 1 and 2 and showing a second embodiment of a rotor according to the invention, produced from the same blades and base segments as the rotor of FIGS. 1 and 2 but with different spacer elements.

As will be seen in FIG. 1, the bladed fan rotor provided by the invention comprises a ring of circumferentially, spaced blades 1 on each of which there is formed a root or base member 2. Between each two adjacent base members 2 there is a spacer member 3. The base members 2 and the spacer members 3 go together to make up a closed segmental ring 4 which is received in a peripheral rim 5 of a central hub 6.

In the ring 4 each base member 2 and the adjacent spacer member 3 are clamped together by a U-shaped clip or clamp member 7 of which the legs 8 engage in two adjacent recesses or slots 9 in the respective base members 2 and spacer member 3. The recesses 9 extend substantially perpendicularly to the peripheral direction of the ring 4.

Each base member 2 and each spacer member 3 has on its two radial side faces 10 a groove 11 or rib 12 extending substantially perpendicularly to the peripheral direction of the ring 4. Furthermore, the base members 2 and spacer members 3 are provided with grooves 13 extending radially outwardly in the direction of the periphery of the ring 4, and projections on the rim 5 of the hub 6 engage in these grooves.

Preferably, the blade members 1 with the base members 2 formed on them and the spacer members 3 and the hub 6 are made of plastic material. The hub 6 in the case illustrated is injection-molded around the ring 4. The blade members 1 with the base members 2 formed on them, the spacer members 3 and the hub 6 together form thereby a rigid fixed body.

In the manufacture of the rotor according to FIG. 1 the process is that the pre-formed blade members 1, all cast or molded in the same mold from plastic material, with the base members 2 molded integrally with them, and the spacer members 3, likewise all produced in the same mold, are assembled together to form a closed ring. Each base member 2 is secured to the adjacent spacer member 3 by a clamp member 7, for example, of sheet metal, which is inserted so that its two legs 8 are received in the two adjacent external slots 9 in the base member 2 and the spacer member 3, as shown in FIG. 2. Then closure plug members or wedges 14, not shown in FIG. 1, are inserted in the recesses 9. The hub 6 is molded around this closed self-sustaining ring 4.

The closure plugs 14, likewise preferably made of plastics material, are designed to fit snugly in the corresponding recesses 9. Likewise, the inclination of the legs 8 of the clamp 7 is matched to the inclination of those side walls of the associated recesses 9 against which they engage. The width $w$ (FIG. 2) of the base of the clamp 7 is chosen acording to the spacing of the flanks at the mouth of the recesses 9 in the assembled ring 4.

With blades 1 pre-formed as individual components integral with their base members 2 and all having the same shape and dimensions, a large number of different bladed rotors can be produced. Without any spacer members 3 at all and with the base members 2 engaging directly against one another and into one another, there is obtained the rotor of basic shape which has therefore a predetermined number of blades 1 and a predetermined hub diameter, the ring 4 having an exactly circular outline. In the case illustrated this rotor has 11 blade members 1.

When a bladed rotor of larger hub diameter but of the same number of blades or a rotor with fewer blade members 1 but of the same or a larger hub diameter is to be produced, then spacer members 3 must be inserted. Where rotors are to be produced having a larger number of blade members 1 and a larger hub diameter, then additional base members 2 and blade members 1 must be incorporated in the ring 4. In each case, in the production of rotors of larger hub diameter, it arises that between each adjacent pair of base members 2 and between the base members 2 and the respective adjacent spacer members 3, a wedge-shaped gap 15 is formed. Before molding of the hub 6 the ring 4 is, however, held together by the clamp member 7.

Naturally in the manufacture of bladed fan rotors having different numbers of blades and/or different hub diameters, spacer members 3 of different peripheral extent are employed. If this extent is too small for the spacer members 3 to be provided with a recess 9, then the clamping of the ring 4 can also be arranged such that the clamp members 7 are each inserted in two adjacent base members 2, bridging across the spacer member 3 between them.

This is the case with the rotor shown in FIGS. 3 and 4. It differs from that of FIGS. 1 and 2 only in that the spacer members 3 are smaller and have no recess 9 and so they are each bridged by a clamp member 7 which has an appropriately greater width *w*. Also the hub diameter and/or the number of blades is different.

The manufacture of the bladed fan rotors according to the invention is made easier in that the ring of blades assembled together is held together before the mounting of the hub and results in a component which is capable of being handled and which can be transported and placed without falling apart. Also the strength of the rotors according to the invention is increased. They can run at higher rotational speeds than hitherto.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. A fan rotor assembly comprising a circular hub, a peripheral rim integral with the hub, said rim having a radial outer side, an annular groove in said radial outer side of the rim defined by a closed radially inward side, an open radially outward side and opposite radially extending sidewalls, and a pair of radially spaced protuberances extending into the groove from each of said sidewalls, a plurality of circumferentially spaced fan blades, arcuate shaped base members disposed in said annular groove of the rim as segments of an annular blade support member, said base members having a radially outer side attached to one of said blades, a radially inward side, opposite laterally spaced end walls and opposite axially spaced side walls, a plurality of peripherally spaced openings in the said radially inward side, a pair of radially spaced grooves in each of said sidewalls which extend from the end walls across the base member and are disposed to mate with the said protuberances which extend into the annular groove in the rim, a groove in one of said end walls and a tonque on the opposite end wall adapted to fit in a said groove in the end wall of an adjacent segment to form a tongue and groove joint, and a clip member having a body and longitudinally spaced legs which are removeably disposed in said openings of adjacent segments to secure them together.

2. The fan rotor of claim 1 wherein only alternate segments in the ring have fan blades and the remaining segments are spacer elements having base portions similar in configuration to the base portions of the bladed segments.

3. The fan rotor assembly of claim 1 wherein a spacer member is disposed between at least two of the said base members, said spacer member having radially spaced opposite sides, axially spaced sidewalls and laterally spaced end walls, peripherally spaced openings in one sidewall similar to those of said base members, axially spaced grooves in its sidewalls similar to those in said base members, and a groove in one end wall and a tongue in the opposite end wall similar to those in said base members, and said clip has one leg in an opening in a base member and one leg in an opening in a spacer member.

* * * * *